US005161721A

United States Patent [19]

Nichols

[11] Patent Number: 5,161,721

[45] Date of Patent: Nov. 10, 1992

[54] HOLSTER WITH SIGHT PROTECTION DEVICE

[76] Inventor: Richard E. D. Nichols, 13223 Black Mountain Rd., #357, San Diego, Calif. 92129

[21] Appl. No.: 639,588

[22] Filed: Jan. 9, 1991

[51] Int. Cl.[5] ..... F41C 33/04

[52] U.S. Cl. ..... 224/243.000; 224/193; 224/911

[58] Field of Search ..... 224/192, 193, 196–198, 224/206, 238, 240, 242–248, 252, 253, 255, 269, 911, 912

[56] References Cited

U.S. PATENT DOCUMENTS

| | | | |
|---|---|---|---|
| D. 187,533 | 3/1960 | Castaneda | D30/1 |
| D. 224,010 | 6/1972 | Barrow | D22/4 |
| D. 259,946 | 7/1981 | Biachi et al. | D22/13 |
| D. 260,800 | 9/1981 | Bianchi et al. | D22/13 |
| D. 285,104 | 8/1986 | Davis | D3/101 |
| D. 289,462 | 4/1987 | Miller | D3/101 |
| D. 293,741 | 1/1988 | Nichols | D3/101 |
| D. 303,875 | 10/1989 | Hill | D3/101 |
| 1,046,912 | 12/1912 | Wanee | 224/912 X |
| 1,430,081 | 9/1922 | Holler | 224/912 X |
| 2,001,321 | 5/1935 | Berns | 224/193 |
| 2,401,174 | 5/1946 | McAuley | 224/243 |
| 2,546,774 | 3/1951 | Ohlemeyer | 224/243 |
| 2,601,586 | 6/1952 | Brice | 224/243 |
| 2,764,326 | 9/1956 | Stanton | 224/912 X |
| 2,893,615 | 7/1959 | Couper | 224/912 X |
| 3,353,728 | 11/1967 | Freed | 224/912 X |
| 3,406,884 | 10/1968 | Perkins | 224/243 |
| 3,583,612 | 6/1971 | Paris | 224/243 |
| 3,642,184 | 2/1972 | Hendricks | 224/912 X |
| 3,955,724 | 5/1976 | Perkins | 224/243 |
| 4,225,067 | 9/1980 | Bianchi | 224/243 |
| 4,312,466 | 1/1982 | Clark | 224/243 |
| 4,378,082 | 3/1983 | Chica | 224/243 |
| 4,485,948 | 12/1984 | Cook | 224/243 |
| 4,591,081 | 5/1986 | Bianchi et al. | 224/192 |
| 4,645,103 | 2/1987 | Bianchi | 224/243 |
| 4,846,383 | 7/1989 | Gallagher | 224/243 |
| 4,858,799 | 8/1989 | Young | 224/243 |
| 4,865,238 | 9/1989 | Bianchi | 224/193 |

*Primary Examiner*—Henry J. Recla
*Assistant Examiner*—Casey Jacyna
*Attorney, Agent, or Firm*—Brown, Martin, Haller & McClain

[57] ABSTRACT

A handgun holster has a front fold to which a strip of material having a central channel and side flanges is secured along the center line of the channel with the channel facing inwardly to receive and protect a handgun sight when a handgun is inserted into, or removed from, the holster. The strip is otherwise unsecured to the holster and can conform to any holster inside radius.

13 Claims, 2 Drawing Sheets

HOLSTER WITH SIGHT PROTECTION DEVICE

BACKGROUND OF THE INVENTION

The present invention relates generally to holsters for handguns, and is particularly concerned with sight protection devices for holsters to accommodate handguns equipped with front and rear sights, and to protect both the handgun and the holster from wear as a result of abrasion between the sights and internal surfaces of the holster as the gun is repeatedly drawn out of the holster and replaced.

Holstering a handgun that is equipped with sharpened front sights in a holster has been addressed in various ways in the prior art. A large proportion of these inventions have been made since 1960. Prior to this, it was common that handguns intended for use as service weapons were equipped with simple "fixed" front and rear sights for use in holsters and to extend the life of the pistol sights. Those handguns intended for competition or other precision shooting were equipped with adjustable sights and were rarely holstered. These adjustable sights were and are typically of high profile and typically are made with very sharp edges and corners.

The adjustable sight began to find favor for those users who had a need to carry their handguns holstered, such as police uniform officers and participants in new forms of competition shooting. This presented a challenge to holster designers. The goal was to make holsters which accommodated handguns with high or sharp front sights and to protect both the handgun and the holster from wear. An unprotected front sight can catch inside the holster, and can gather debris from the holster during the drawing motion and thereby produce an unsatisfactory sight picture for the user. Also, the sight can be worn bright by the friction against the holster, resulting in an unsatisfactory sight picture for the user, especially a demanding, knowledgeable user such as a competition shooter.

The conventional, traditional holster has a simple fold of leather forming the front of the holster inside which the handgun sight is disposed. Such holsters have been made for handguns since the 19th century, and are adequate for plain handgun sights. Sharp, adjustable, or high-profile sights can rub on the inside of such a holster and abrade both the holster and the sight. In the extreme cases, the front sight of the handgun can catch on the inside of the holster, especially a holster with a soft lining, and may be difficult or impossible to draw. The front sight of the pistol may even become so thoroughly snagged inside the holster lining that the pistol can only be removed by cutting the holster open.

Holsters have also been made by the folding of the holster at the back of the gun and forming a seam in front of the holster in which the handgun's front sight can be disposed. A welt or leather spacer was commonly stitched into this seam to provide a solid rubbing block for the front sight.

Common among makers of competition holsters is the sight rail, which consists of two separate rails of leather which are stitched inside the holster front and often only to the holster's lining. These two rails, when properly spaced, provide effective sight protection by bearing on the top of the pistol and thereby creating a sight groove. However, a labor intensive process is needed to attach the rails, which first must be cut, prepared by skiving the tips if desired, then glued in place after ensuring that the spacing is ideal, and finally stitched in place with heavy-duty stitching machines and with four sets of loose threads to be trimmed.

Holsters are also sometimes made in two pieces, particularly thin holsters intended for concealment applications. This forms a seam all around the gun pocket, with the front seam forming a space for the handgun's front sight. This is adequate for leather construction and for light holsters, but is inadequate for heavy-duty holsters such as used by police officers and is inadequate for many soft fabric holsters.

Another technique involves forming a groove or channel into the front fold of the holster, using pressure. This groove protects the front sight of the handgun. The method is suited to leather or plastic holsters. In an non-reinforced form, the leather is simply molded into a channel. In a reinforced form, the holster is made from two layers of leather with a layer of metal sandwiched between them, and then formed to produce a permanent channel. This has also been used in thermally-shaped plastic holsters.

Another known sight protector is formed by exaggerating the natural fold of the holster to form a distinct pocket for the front sight. This method has been used extensively.

Another little-used method is to place a groove or slot in the holster lining, usually by using two liner halves which are spaced apart to accommodate the front sight. This method is actually ineffective unless the slot is reinforced with skived strips between the layers along each side of the slot, because the holster naturally folds on the weakening slot and closes the slot.

U.S. Pat. No. 2,401,174 of McAuley shows a groove and slot—a keyhole effect—cut into a holster that was made from a solid block of wood or plastic, into which the pistol barrel and sight was inserted. The purpose of the sight groove appears to have been incidental to providing for the fitting of the revolver barrel into the holster block, and to force the revolver itself into a more concealable position. The strain on the front sight's attachment would have been excessive with this design.

U.S. Pat. No. 2,546,774 of Ohlemeyer discloses a sight protector which generally relies on a slot being cut into the front fold of the holster. In one version, a channel member of uniform thickness has a central, sight receiving groove and is placed inside the fold of the holster and stitched along both outermost edges. Once the device is stitched into the holster, the holster is difficult to fold and folding results in distortion of the device. It also does not conform to the shape of different holster designs and individual holsters, nor to individual handguns, nor is it suited to the latest holster technologies such as fabric, padded fabric, nor plastic.

In U.S. Pat. No. 3,406,884 of Perkins a grooved member is placed into a seam in the front of the holster. This front seam weakens the holster and adds unwanted bulk, and is unsuited to the fabric and plastic technologies popular for holsters today. In addition, Perkins' device can only be attached to the holster with heavy-duty harness-type stitching machines. The Perkins' inventions' advantage is that it does indeed protect the front sight of the handgun and proved to be commercially successful.

For fabric holsters the challenge was significant. The leading device in this field is described in U.S. Pat. No. 4,485,948 of Cook. The Cook patent discloses a strip of nylon or other woven webbing, dipped in a hardening agent to provide spine stiffness for the holster, and stitched in place inside the holster's front fold. As a sight protector this invention actually serves best in the role of protecting the holster from abrasion, and subsequent jamming of the handgun inside the holster. It does not actually provide a protective nest for the sight, but instead provides a protective wear strip for the holster.

U.S. Pat. No. 4,645,103 of Bianchi and Nichols discloses a tubular webbing with a strip of plastic inserted. The stitching of the combined parts to the inside of the holster fold creates an intentional weakness in the plastic: sharply folding the holster serves to fracture the plastic along the stitch lines and creates a shallow channel for the front sight of the handgun. This holster device is all fabric and is unlikely to be used in any holster other than a fabric one; building the component is labor intensive enough—cut the webbing to length, cut the plastic to length, insert the plastic, attach the assembly—that the manufacturer now frequently omits the plastic; and while the protector does perform a function, it does not bear on the top of the handgun to provide a protective pocket for the front sight. This invention is actually a protective wear strip, like the Cook product, while allowing the holster to fold naturally into a rounded cross-section.

U.S. Pat. No. 4,846,383 of Gallagher was developed to compete with two Cook patents which regulate the manufacture of padded fabric holsters. By using an extrusion of plastic for forming both a sight channel and to join two halves of a fabric holster, the inventor was able to produce a padded fabric holster. This method requires that the holster be made in two halves.

SUMMARY OF THE INVENTION

It is an object of this invention to provide a new and improved sight receiving channel for a handgun holster.

According to the present invention, a holster is provided which comprises a sheet of material folded along a front fold to form a handgun receiving cavity, and a strip of material having a central channel extending along its length and side flanges projecting from each side of the central channel, the strip being secured along the center line of the channel to the inner face of the front fold of the handgun receiving cavity, and being otherwise unsecured to the holster.

Because the side flanges of the strip on opposite sides of the center line are free and unsecured to the underlying holster material, the holster material can be freely folded into any desired curvature at the strip location, with the side flanges slidably conforming to the ultimate holster shape. The strip may be formed with an initially flat or partially curved cross-section, and will then bend to adopt the curvature of the front fold of the holster as the holster material is itself folded to form the handgun cavity. Alternatively, the strip may be preformed with a curvature corresponding to that of a particular holster.

The present invention provides a low-cost form of true sight protection that is easily attached with common sewing machines inside holsters of conventional, compact profile made from all the present and past technologies for holsters.

The strip may be secured to the holster material along its center line by stitching, rivets or the like. The channel is configured to produce a groove for receiving at least the front sight of a handgun during insertion and removal of the gun, when the sheet of material to which it is secured is folded to form the handgun receiving cavity. The holster may be of a shortened design so that the front sight of the handgun projects from the lower end of the holster when the gun is holstered, and travels along the groove as the gun is drawn to prevent snagging during the draw. Alternatively, the holster may be of more conventional design in which the front sight at least will be within the channel when the gun is fully inserted into the holster. The strip adds spinal stiffness to the front of the holster in addition to providing a groove for receiving the handgun sights, and can be used conveniently with any front folding holster design and any conventional holster materials.

The strip may be flat but sufficiently flexible to be bent into an arcuate configuration on bending of the holster material to form the front fold of the holster, or may be preformed with the desired arcuate cross-section. The groove or channel is preferably of rectangular cross-section but may have outwardly flared side edges to form a rectangular channel when the strip has been bent to the desired curvature with the material forming the holster. The leading edges of the side flanges may be skived away to form ramps at the inlet end of the holster, for easy insertion and removal of the handgun.

The holster with handgun sight receiving channel is easy and inexpensive to manufacture, since the strip containing the channel can be purchased and inventoried in roll form and cut to length as needed for use with a particular holster design, rather than shaped and stored in a variety of sizes. Additionally, only a single seam of single or multiple rows of stitching is required to join the strip to the holster material when flat, without any need for additional seams or gluing, saving both time and materials.

BRIEF DESCRIPTION OF THE DRAWINGS

The present invention will be better understood from the following detailed description of some preferred embodiments of the invention, taken in conjunction with the accompanying drawings, in which like reference numerals refer to like parts, and in which.

DESCRIPTION OF THE PREFERRED EMBODIMENTS

Figure 1:
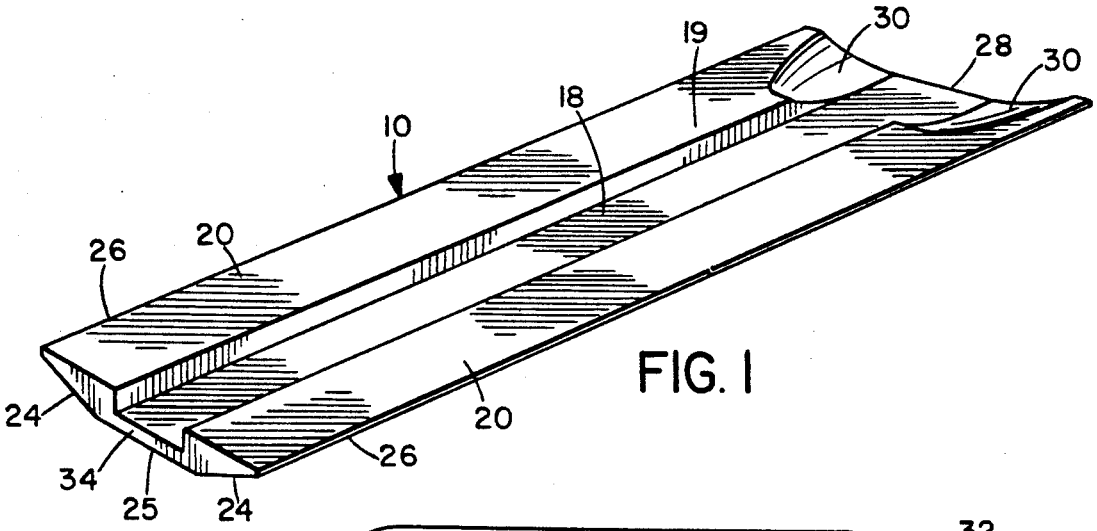
FIG. 1 is a perspective view of a preferred configuration of the sight protection strip.
Figure 2:
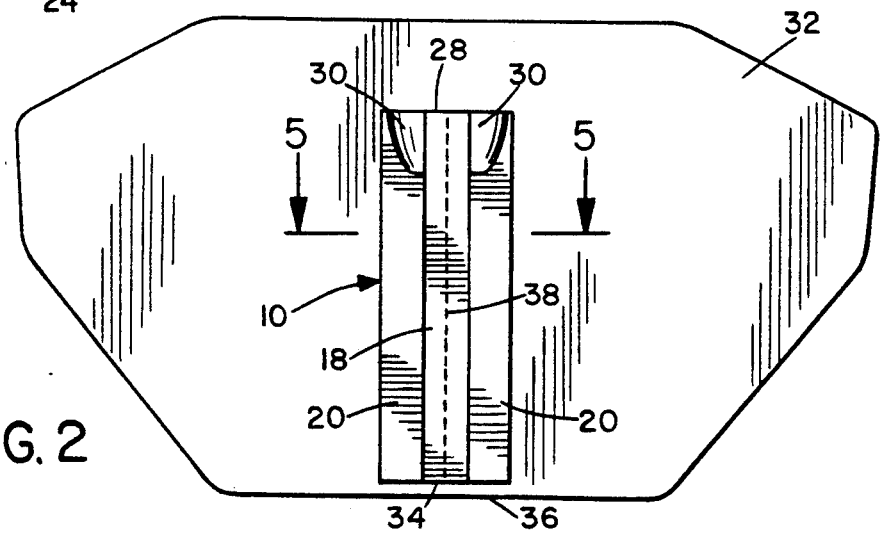
FIG. 2 is an inside view of the flat pattern of a typical holster with the sight protection strip attached.
Figure 3:
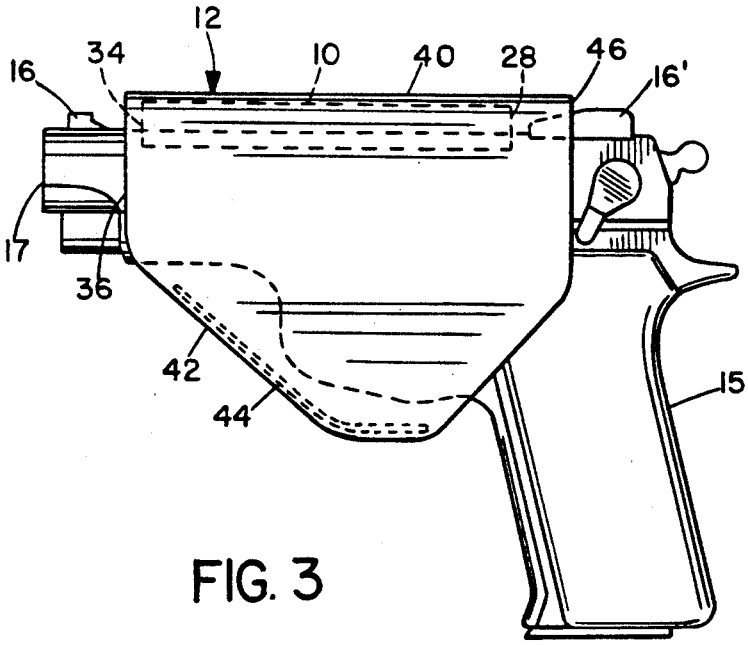
FIG. 3 is a side elevation view of the completed holster with a semiautomatic pistol in place.
Figure 4:
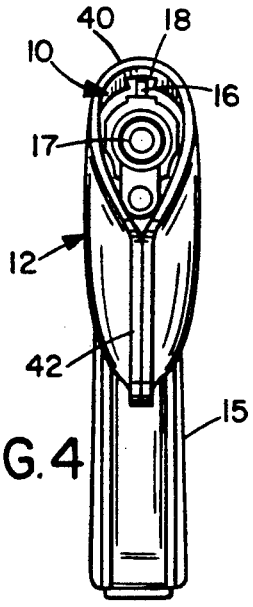
FIG. 4 is a front end view of the holster and pistol combination.
Figure 5:
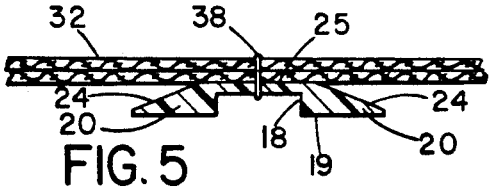
FIG. 5 is an enlarged sectional view taken on line 5—5 of FIG. 2.
Figure 6:
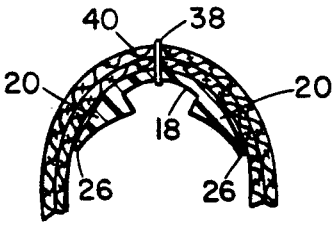
FIG. 6 is a view similar to FIG. 5, with the holster folded into completed position.
Figure 7:
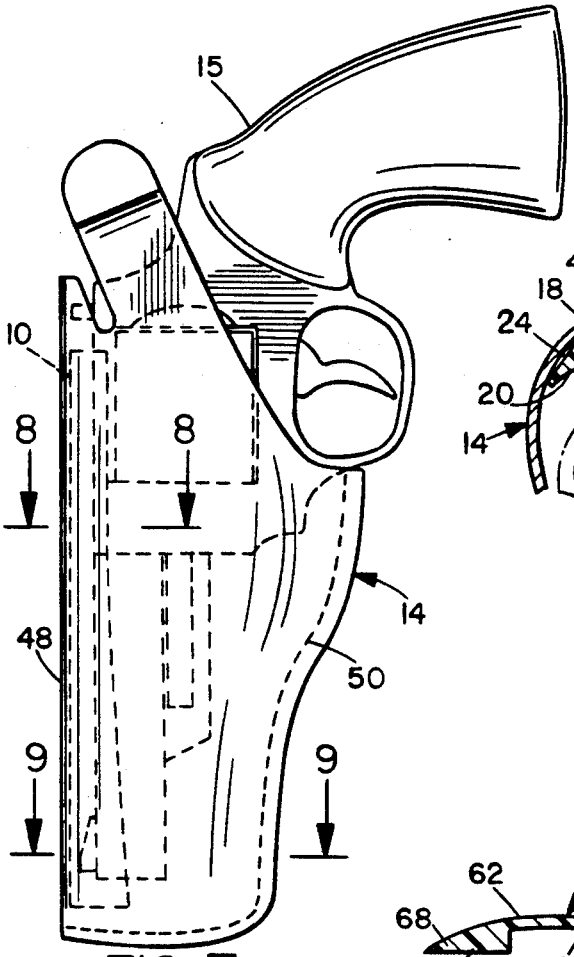
FIG. 7 is a side elevation view of another type of holster with a revolver in place.

FIG. 1 of the drawings illustrates a sight protection device or strip 10 according to a first embodiment of the invention, while FIGS. 2, 5 and 6 illustrate steps in assembling the strip 10 into a holster 12, and FIGS. 3 and 4 illustrate use of a holster 12 with the strip 10 in place. FIG. 7 illustrates use of strip 10 in a different type of holster 14. The strip is designed to allow easy insertion and removal of the type of handgun 15 having front and rear sights 16, 16' projecting upwardly from the barrel, slide or frame 17 of the gun, as best illustrated in FIGS. 3 and 4.

Device 10 is an essentially flat strip made of any suitable material having some flexibility, such as plastic, rubber, leather or similar materials which can be stitched. The strip 10 has a sight receiving channel 18 of rectangular shape formed in the center of one face and extending along the length of the strip, with side flanges 20 projecting from each side of channel 16. The side flanges 20 have skived or tapering surfaces 24 on the opposite face 25 of the strip which extend outwardly to the outermost side edges 26 of the strip. The strip may be manufactured using extrusion, machining, compression molding, injection molding, laminating, or other processes dependent on the type of material used, and is preferably formed in a continuous strip to be stored in roll form and cut to appropriate lengths as needed for a particular holster design, although it may alternatively be molded into a particular size.

The sight protection strip 10 as illustrated in FIG. 1 has been cut to an appropriate length for use in a selected holster, and is assembled with the holster. Preferably, the side flanges 20 at the leading edge 28 of the strip have skived or ramped regions 30 adjacent channel 16, to provide a ramp for easy insertion and removal of a handgun into and out of the holster, as will be explained in more detail below. The strip may be attached to any type of holster having a front fold, including those having rear seams as illustrated as well as those with both front and rear folds.

In order to assemble the strip 10 into holster 12, a sheet 32 of material for forming holster 12 is first cut to the appropriate shape and dimensions and laid out flat, as illustrated in FIG. 2. The strip 10 is placed on the innermost face of sheet 32 with the channel facing upwardly, the center line of the channel extending along the center line of sheet 32, and its trailing edge 34 adjacent the edge 36 of the sheet which will correspond to the lowermost end of the assembled holster. The strip is then secured to sheet 32 via stitching 38 extending along the center of the channel, as illustrated in FIGS. 2 and 5. The stitching may comprise simple, double, or multiple rows of stitching extending along the central region of the channel. Since the strip 10 is relatively thin at the center of the channel, as best seen in FIG. 5, it can be attached easily using lightweight industrial sewing machines. The strip is otherwise completely unsecured to the sheet 32, and the side flanges are free and unattached. Thus, the assembly requires only one set of stitching, and no gluing or bonding is needed.

At this point the sheet 32 is folded along its center line to form the front fold 40 of the holster, and its rear edges 42 are suitably aligned and secured together via stitching 44 or the like to form the rear seam of the holster. As can be seen in FIG. 6, the strip 10 will readily conform to the resultant configuration or curvature of the front fold, and will retain its new shape, since the side flanges are free to bend and adopt any final curvature as determined by the bending of the overlying holster forming sheet 32. The bending of the side flanges is assisted in the embodiment illustrated in FIGS. 1 to 6 by the tapering outer faces of the side flanges, although this is not essential. With a rectangular channel preformed in the strip as in FIG. 1, when the strip has been bent in conformity with the front fold of the holster, the resultant channel will have the configuration illustrated in FIG. 6, in which the side walls of the channel are inclined inwardly towards one another to form a restricted opening.

The strip itself will provide spinal stiffness to the holster as well as providing a sight protection channel. This added stiffness is particularly useful in holsters made of fabric material rather than leather or plastic. The strip can be applied to all types of front fold holsters, including lined and unlined leather, plain or padded fabric, and plastic laminate holsters. Although in the preferred embodiment illustrated the strip is attached by standard stitching, it may be attached by riveting along the center line where the application warrants this form of attachment. The feathering or tapering thickness of the side flanges reduces bulk and enhances foldability of the strip to conform to the holster curvature.

FIGS. 3 and 4 illustrate a holster 12 with sight protection device 10 secured along the front fold 40 via stitching 38 with the sight receiving channel 18 facing inwardly. When the barrel 17 of handgun 15 is inserted into holster 12, the front sight 16 will enter the leading end of channel 18 and will be guided along the channel which is designed to be of appropriate dimensions for freely receiving the handgun sights without abrasion or snagging of the sights against the inner or side faces of the channel. The skiving 24 of the side flanges at the leading end of the device provides a ramp for easy insertion of the gun with the barrel either straight or at an angle. The holster 12 of FIGS. 3 and 4 is of a short design in which the forward end of the barrel 17 projects from the lower end 36 of the holster when the gun is fully inserted, as in FIG. 3. At this point the rear sight 16' will be partially within the rear end of holster. Although rear sight 16' is not within channel 18, the strip 10 will act as a spacer against the frame or slide of the gun to produce a natural pocket 46 to protect the rear sight 16' as illustrated in FIG. 3, preventing or reducing the risk of snagging of rear sight 16' against adjacent surfaces of the holster either on drawing or inserting the gun. With this arrangement, the handgun or pistol may be angled during insertion or removal without snagging, since the front sight is guided into and along the channel both during insertion and removal of the gun. Skiving may also be provided on the side flanges at the rear or trailing edge 34 of the strip, similar to the skived portions 24 at the leading edge, to produce a ramp for easy guiding of the front sight back into the channel as the handgun is removed.

The overall dimensions of the strip and channel will be dependent on the design or designs of holster and handgun with which it is to be used. In one example of the version illustrated in FIG. 1, the width of the strip was around 1.5 inches, the width of the channel was around 0.5 to 0.75 inches, and the depth of the channel was around 0.15 to 0.20 inches.

FIG. 7 illustrates an alternative, long holster design in which the barrel 17 of the gun is completely enclosed within the holster 14. This type of holster is also made by folding a sheet of suitable material along a center line to form a front fold 48 and stitching to form a continuous seam 50 along its rear and lower edges, defining handgun receiving cavity or pocket 52. Prior to the folding step, a length of strip 10 is formed or cut to extend along substantially the entire length of the front fold 48 of the holster, and is stitched to the fold line via stitching 38 extending along the center line of the channel, as in the previous embodiment, with the channel 18 facing inwardly. The holster material is then folded along the center line with the rear and lower end edges in alignment prior to stitching along seam 50. With this holster design, the front fold is of varying curvature or internal diameter, the curvature generally becoming greater towards the lower end of the holster, as can be seen by comparison of FIGS. 8 and 9. Since the strip 10 is secured only via the single line of stitching along its center and the sides of the strip are free and unattached, they can easily conform to the varying curvature along the length of the holster, adopting a greater curvature towards the lower end of the holster as illustrated in FIG. 9. As in the version of FIGS. 3 and 4, the resultant channel 18 will be shaped and dimensioned to receive the front sight of the gun without abrasion or snagging during insertion and removal. Unlike the version of FIGS. 3 and 4, the front sight will be within the channel when the gun is fully inserted in the holster, as illustrated in FIG. 7. The sight protector strip can therefore be assembled into any standard type of front fold holster for receiving handguns of various designs and dimensions, and will protect the sights of the handguns from snagging or abrasion during insertion and removal, reducing the risk of the sights gathering debris during removal, for example, which could result in unsatisfactory operation of the sights, and also reducing or eliminating the risk of the sights wearing bright as a result of friction during the drawing and holstering motions. Clearly, snagging of a handgun during drawing is undesirable since it will reduce the speed of the draw, and may also potentially result in damage to the holster or the handgun itself. The sight protection device as illustrated and described substantially or completely eliminates this potential problem.

Figure 8:
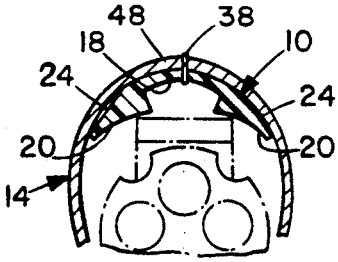
FIG. 8 is an enlarged sectional view taken on line 8—8 of FIG. 7.
Figure 9:
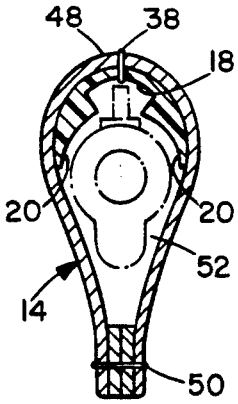
FIG. 9 is an enlarged sectional view taken on line 9—9 of FIG. 7.
Figure 10A:
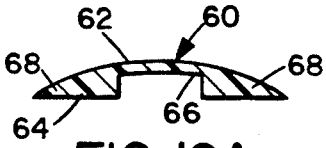
FIGS. 10A–10G are views illustrating alternative cross-sectional configurations for the sight protection strip.

Although the sight protector strip of FIGS. 1 to 9 is initially manufactured as a basically flat strip with a rectangular channel, other alternative cross-sectional configurations may be used in other embodiments, as illustrated in FIGS. 10A to 10G, for example. In each of these alternatives, the strip will be attached to the holster front fold in the same manner as illustrated in FIGS. 2, 5 and 6 for the first embodiment, via stitching or other attachment means such as rivets extending along the center of the sight channel. In the embodiment of FIG. 1, the outer face 25 of the strip which is secured against the front fold of the channel has a flat central region and tapered outer side portions 24 which conform readily to the curvature of the holster front fold on assembly, as illustrated in FIGS. 6, 8 and 9. FIG. 10A illustrates an alternative strip configuration 60 in which the outer face 62 is formed with a continuous, arcuate curvature, while the inner face 64 containing rectangular sight channel 66 has flat side flanges 68. This also will readily conform to any holster fold curvature, or may alternatively be molded to fit a specific holster curvature.

Figure 10B:
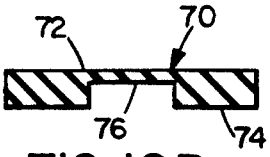

FIG. 10B illustrates another modified strip 70 in which the strip is completely flat on both of its opposing faces 72, 74, and has a rectangular sight groove or channel 76. Again, the strip will bend along the central stitching line when attached to the holster material to adopt the resultant curvature of the holster front fold. In practice, the strip may be manufactured with any overall cross sectional between fully flat on both faces as in FIG. 10B, and fully curved, depending on the application and type of material used in making the strip.

Figure 10C:
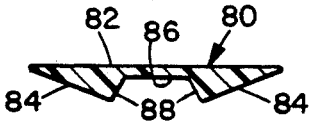

FIG. 10C illustrates another modified strip 80 which has a flat outer face 82 as in the previous embodiment, but in which the side flanges 84 taper outwardly on the opposite face from the side edges of the channel 86 to the outer side edges of the strip. Another difference in this embodiment is that the channel is formed with outwardly tapering or inclined side walls 88, so that when the strip is attached to the holster material and the material is bent to form the front fold of the holster, the channel 86 will be of substantially rectangular or square cross-sectional shape. In fact, the strip 80 of FIG. 10C will adopt substantially the configuration illustrated in FIG. 10D when assembled into a holster. This results in a less restricted sight receiving channel than that of the first embodiment. Alternatively, the strip 90 of FIG. 10D may be pre-formed with the curvature and square cross section channel 92 as illustrated in FIG. 10D, for fitting a specific holster design.

Figure 10F:
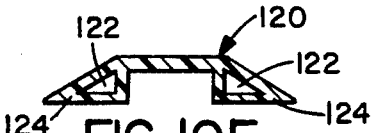
Figure 10G:
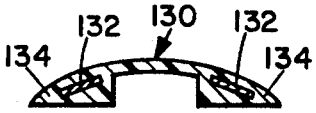
Figure 10D:
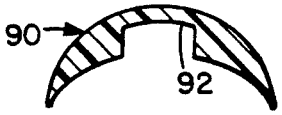
Figure 10E:
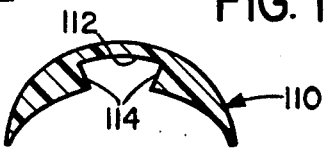

FIG. 10E illustrates another alternative strip 110 which is manufactured with an overall curvature as in FIG. 10D, but has a more restricted sight channel 112 with inwardly tapering side walls 114. This may again be formed to fit a particular holster design, or may be adaptable to different designs by bending the strip about its center line to produce an increased curvature, as in the strip of FIG. 10D.

Although various alternative strip profiles are illustrated, other alternatives may also be used within the range from completely flat to completely curved, as appropriate for particular applications.

FIG. 10F illustrates a strip 120 of the same overall cross-sectional configuration as FIG. 1, but with bores 122 cored out in its side flanges 124 to provide increased flexibility and cushioning of the handgun. Bores may be provided in an equivalent manner in any of the alternative strips illustrated, if desired.

Finally, FIG. 10G illustrates another modified strip 130 which is of similar cross sectional configuration to that of FIG. 10A, but which has metal strips 132 or other stiffening members embedded in and extending along its side flanges 134 to produce increased spinal stiffness in the holster. This would be useful for holsters manufactured of relatively soft material, such as fabric or some plastics.

As described above, the sight protection strip may be manufactured as a completely flat strip, a partially or semi-curved strip, or a completely pre-curved strip, depending on the application and the materials of the holster and strip, and the groove will be appropriately shaped and dimensioned to adopt the desired configuration when assembled into the holster. The strip will easily adjust to all standard front fold holster inside radii, either by manufacturing the strip with the required curvature initially, or by bending the strip along its center line to adopt the corresponding curvature as the holster material is folded along its center line during manufacture of the holster. The sight protection device is relatively inexpensive both to manufacture and to assemble into a holster during manufacture, since stitching is required only along the center of the channel and this can be accomplished by a standard, light duty industrial sewing machine. Thus, it does not add significantly to the complexity of the holster manufacture, and will not increase the cost of the holster to any great extent. No gluing or bonding is required, saving both time and materials.

The sight strip may be manufactured of various materials of varying stiffness depending on the type of holster, and in hardnesses ranging from soft (for holsters of relatively rigid material) to very firm (for holsters of inherently soft material). It may be made from rubber, leather, plastic, or any material that can be stitched or riveted. It may be made of a relatively slick material to promote a fast draw of the handgun, for example, or of less slick materials for increased retention, according to manufacturer's and customer's requirements. The strip may be of any desired color.

The device is compact and does not detract in any way from the external holster design. It enhances spinal stiffness at the front fold of the holster, reducing the risk of damage and improving retention capability. It allows a handgun to be readily inserted and removed by guiding the front sight or front and rear sights along the sight channel and spacing the or each sight from the inner face of the channel. This reduces the risk of snagging, abrasion, and potential damage to both the holster and the gun sights. The handgun can be inserted or removed at an angle without difficulty. It is suitable for any design of front fold holster, and any standard holster material.

The strip may be manufactured in a continuous strip and stored in a roll, for example, with appropriate lengths being cut from the roll as needed during holster manufacture. This also significantly reduces expense and storage space requirements. Alternatively, the strip may be made in various custom lengths and configurations. The sight channel dimensions will be dependent on the sight dimensions, and strips having channels of varying dimensions for receiving all standard handgun sights will be provided.

Although some preferred embodiments of the invention have been described above by way of example only, it will be understood by those skilled in the field that modifications may be made to the disclosed embodiments without departing from the scope of the invention, which is defined by the appended claims.

I claim:

1. A holster for a handgun, comprising:

a holster body having a handgun receiving cavity for receiving a handgun, the cavity having spaced side walls and spaced ends, at least one end of the cavity comprising a fold;

a strip of material having a preformed, indented central channel in one of its faces, the channel having a base and spaced side walls and extending along at least part of the length of the strip and side flanges projecting from each side of the channel, the strip being of reduced thickness at the base wall of the channel;

securing means for securing the strip along the length of the channel to the fold forming an end of the handgun receiving cavity with the channel facing inwardly into the cavity;

the securing means extending along the channel and being confined within the width of the channel, all remaining areas of the strip on opposite sides of the securing means being free and unsecured to the underlying holster body; and the channel comprising means for receiving at least a front sight projecting upwardly from a handgun as the handgun is inserted in a holster.

2. The holster as claimed in claim 1, wherein at least one face of the strip is of arcuate shape.

3. The holster as claimed in claim 2, wherein the strip is formed with an arcuate cross section.

4. The holster as claimed in claim 1, wherein the channel is of rectangular cross-section.

5. The holster as claimed in claim 1, wherein the channel has side walls which taper outwardly towards the outer end of the channel for forming a channel of rectangular cross-section when the strip is bent along the center line of the channel.

6. The holster as claimed in claim including stiffening means in the side flanges of the strip for stiffening the front fold of the holster.

7. The holster as claimed in claim 6, wherein the stiffening means comprise strips of metal embedded in the side flanges of the strip and extending along the length of the strip.

8. The holster as claimed in claim 1, wherein the side flanges have bores extending along the length of the respective flanges for increasing the flexibility of the strip material in the flange region.

9. The holster as claimed in claim 1, wherein the side flanges are of gradually reducing thickness between each side edge of the channel and the outermost side edge of the respective flange.

10. The device as claimed in claim 1, wherein said holster body comprises at least one sheet of material folded to form at least part of said handgun receiving cavity, the material having at least one fold forming said end of the cavity.

11. The holster as claimed in claim 10, wherein the strip is a flat member bent into an arcuate configuration by folding the sheet to which it is secured to form the handgun receiving cavity.

12. The device as claimed in claim 1, wherein the central channel extends along the entire length of the strip.

13. The device as claimed in claim 1, wherein said securing means extends along the center line of the channel.

* * * * *